United States Patent [19]

Wischoff

[11] Patent Number: 4,470,509

[45] Date of Patent: Sep. 11, 1984

[54] SPINDLE INNER PACKING STRUCTURE

[75] Inventor: Donald F. Wischoff, Fulton, N.Y.

[73] Assignee: Container Corporation of America, Chicago, Ill.

[21] Appl. No.: 468,580

[22] Filed: Feb. 22, 1983

[51] Int. Cl.[3] ..... B65D 85/04

[52] U.S. Cl. ..... 206/408; 206/303; 206/396; 242/118.8

[58] Field of Search ..... 242/77.3, 118.8; 211/59.1; 229/17 S; 206/521, 587, 591, 592, 482, 303, 389, 394, 395, 396, 407, 408

[56] References Cited

U.S. PATENT DOCUMENTS

| | | | |
|---|---|---|---|
| 2,646,953 | 7/1953 | Cinami | 248/116 |
| 2,737,292 | 3/1956 | Neff | 206/303 |
| 2,788,892 | 4/1957 | Dales | 206/408 X |
| 2,943,732 | 7/1960 | Kovaleski et al. | 206/389 |
| 3,389,848 | 6/1968 | McKee | 206/521 |
| 3,554,460 | 1/1971 | Reas | 242/118.8 |

FOREIGN PATENT DOCUMENTS

| | | | |
|---|---|---|---|
| 789651 | 8/1935 | France | 242/118.8 |
| 52-45486 | 4/1977 | Japan | 206/303 |
| 651658 | 4/1951 | United Kingdom | 242/118.8 |
| 730402 | 5/1955 | United Kingdom | 242/118.8 |

*Primary Examiner*—William Price
*Assistant Examiner*—Gary E. Elkins
*Attorney, Agent, or Firm*—Richard W. Carpenter

[57] ABSTRACT

An inner packing structure for supporting a hollow roll in a dispensing package and comprising a pair of end panel sections and a spindle extending therefrom which includes a center panel and pairs of opposed side panels interconnecting the center panel and the end panel sections.

1 Claim, 5 Drawing Figures

SPINDLE INNER PACKING STRUCTURE

BACKGROUND OF THE INVENTION

1. Field of the Invention

This invention relates generally to inner packing structures, and more particularly to a spindle structure for use in a package containing a roll for dispensing sheet material.

2. Description of the Prior Art

A prior art search in the U.S. Patent and Trademark Office directed to the subject matter of this application disclosed the following U.S. Pat. Nos.: 1,176,786; 2,646,953; 2,788,892; 3,280,987; 3,337,113.

None of the prior art patents uncovered in the search discloses a unitary packing structure for forming an inner spindle arrangement, which structure includes a center panel having opposed pairs of side panels joined thereto and extending therefrom toward a pair of end panel sections, wherein one pair of side panels has end portions formed from material of and foldably joined to respective end panel sections.

SUMMARY OF THE INVENTION

It is an object of the invention to provide a one-piece paperboard spindle structure for use in supporting a roll in a dispensing package for sheet material.

A more specific object of the invention is the provision of a spindle arrangement for an inner packing structure which includes a pair of side panels extending from a central panel to an end panel with one pair of side panels being foldably joined to the end panel and having interlocking engagement with other the other side panels.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
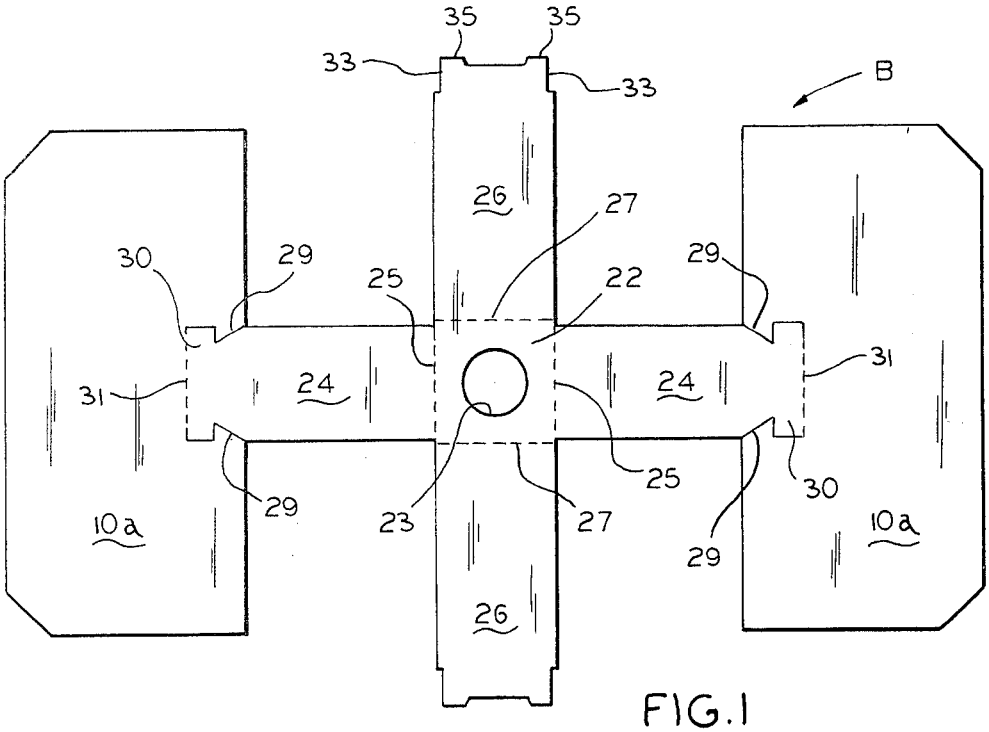
FIG. 1 is a plan view of a blank of foldable sheet material from which the spindle packing structure illustrated in the other views may be formed.
Figure 2:
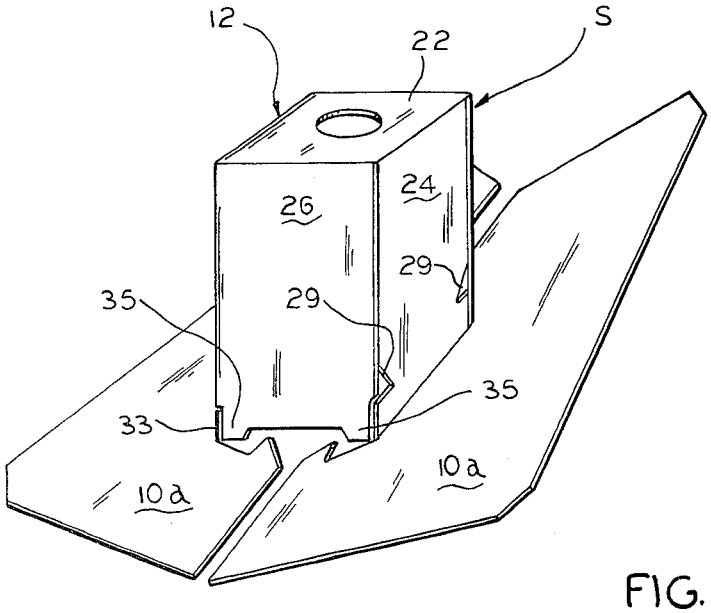
FIG. 2 is a perspective view illustrating one step in the formation of the spindle structure from the blank illustrated in FIG. 1.
Figure 3:
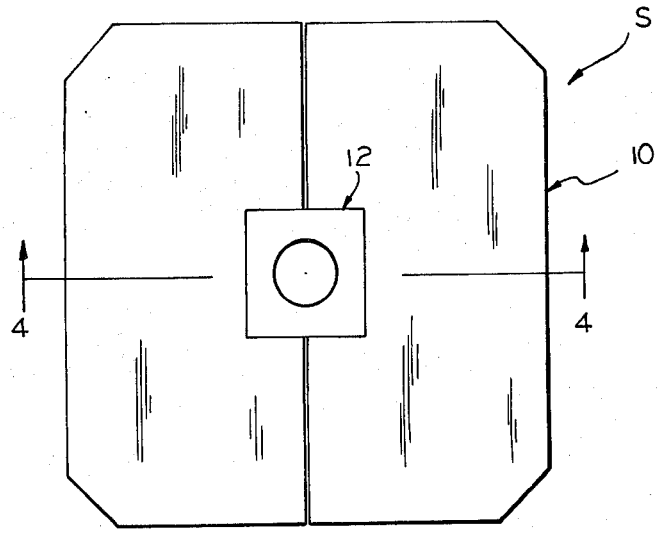
FIG. 3 is a top plan view of a spindle structure illustrating features of the invention, as shown in the erected condition.
Figure 4:
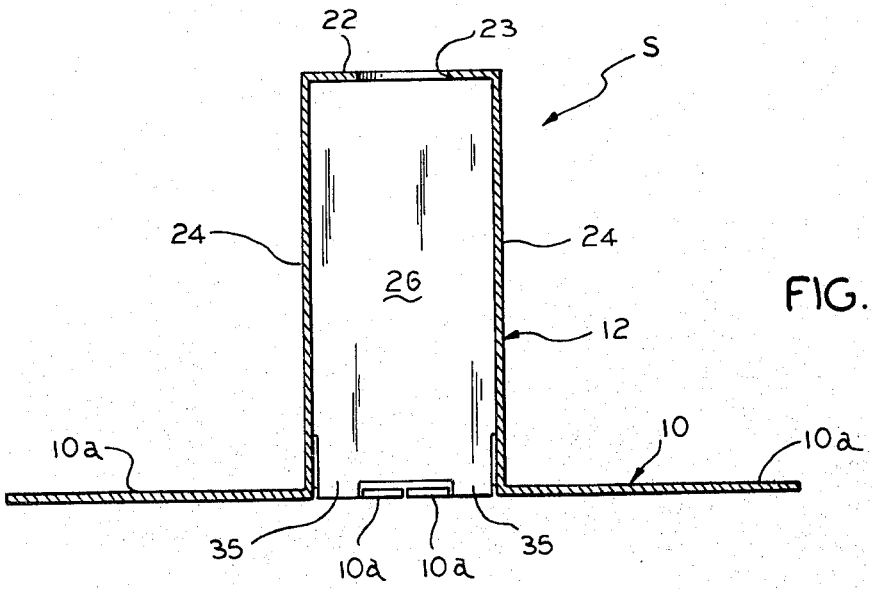
FIG. 4 is a fragmentary transverse vertical sectional view taken on line 4—4 of FIG. 3.

Referring now to the drawings for a better understanding of the invention and particularly to FIGS. 1, 2, and 4, it will be seen that the novel inner packing spindle structure, illustrated generally at S in FIG. 2 may be formed from the unitary blank B of foldable paperboard illustrated in FIG. 1.

As best seen in FIG. 1, the structure includes a base or end panel indicated generally at 10 comprising a pair of coplanar base or end panel sections 10*a* which are positioned in side-by-side relationship.

A spindle structure indicated generally at 12, includes a preferably rectangular center panel 22, with a central aperture 23, and having opposed pairs of generally elongated first and second side panels 24 and 26 foldably joined at corresponding ends along fold lines 25 and 27 to corresponding side edges of center panel 22 and extending therefrom toward end panel 10.

First side panels 24 have other end portions or feet 30 which are formed from material of respective end panels 10*a* and are foldably joined thereto along fold lines 31.

End portions 30 of panels 24 may be provided with notches 29 which serve to accommodate interlocking connection between first and second side panels in a manner hereinafter described.

Second side panels 26 are provided adjacent their ends with recesses 33 in opposite side edges thereof and with lugs or projections 35 which extend outwardly from the ends thereof interlocking connection within panel sections 10*a* as hereinafter described.

As best seen in FIGS. 2 and 4, to form the spindle packing structures from the blank B, end panel sections 10*a* are brought in edge-to-edge relationship with each other and side panels are folded at right angles to the center panel 22 and to the end panel sections 10*a*.

Figure 5:
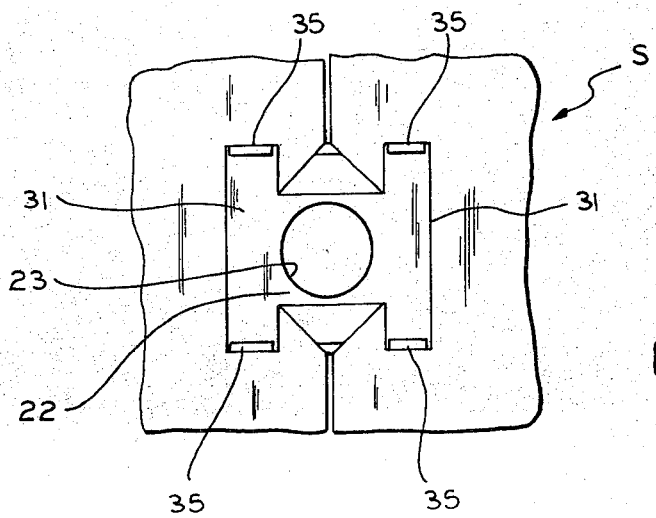
FIG. 5 is a fragmentary bottom plan view of the structure illustrated in FIGS. 3 and 4.

The recesses 33 in second side panels 26 form shoulders which are received within the notches 29 of first side panels 24, with portions of first side panels 24 being received in recesses 33 of second side panels 26. At the same time the projections 35, which extend from the ends of the second side panels 26, are received within related openings in end panel sections 10*a*, as best seen in FIGS. 4 and 5.

Thus, it will be appreciated that the invention provides relatively simple means of forming a spindle inner packing structure from a blank of foldable sheet material which accommodates interlocking connection between the parts without requiring the use of any outside securing means such as glue or staples.

What is claimed is:

1. An inner packing device for supporting a hollow roll, said device being formed from a unitary blank of foldable sheet material, such as paperboard, and comprising:

(a) a base panel including a pair of generally coplanar base panel sections disposed in side-by-side relation;

(b) an integral spindle including:

(i) a generally square center panel disposed generally parallel to but spaced from said base panel;

(ii) pairs of elongated, opposed first and second side panels having corresponding ends foldably joined to side edges of said center panel and extending normally therefrom toward said base panel with their respective side edges disposed adjacent each other;

(c) said first side panels having other ends remote from said center panel which:

(i) have portions formed from material of respective base panel sections and are foldably joined thereto;

(ii) present on opposite sides thereof notches for receiving portions of respective second side panels;

(d) said second side panels having other ends remote from said center panel which:

(i) present shoulders on opposite sides thereof for engagement with respective first side panel notches;

(ii) present recesses on opposite sides thereof adjacent said shoulders for receipt of portions of respective first side panels;

(iii) have lugs projecting from the ends thereof for receipt within related apertures of said base panel sections.

* * * * *